US005867110A

United States Patent [19]

Naito et al.

[11] Patent Number: 5,867,110

[45] Date of Patent: Feb. 2, 1999

[54] INFORMATION REPORTING SYSTEM

[75] Inventors: Akira Naito, Fujisawa; Hiroshi Shimizu, Yokohama; Chiyo Akamatsu, Yokohama; Takahiko Nozoe, Yokohama, all of Japan

[73] Assignee: Hitachi, Ltd., Tokyo, Japan

[21] Appl. No.: 696,028

[22] Filed: Aug. 9, 1996

[30] Foreign Application Priority Data

Aug. 11, 1995 [JP] Japan ..... 7-205989

[51] Int. Cl.[6] ..... G08G 1/123

[52] U.S. Cl. ..... 340/995; 340/988; 340/990; 701/201; 701/209; 701/211

[58] Field of Search ..... 340/995, 988, 340/990; 364/443, 449.6, 449.1; 701/201, 209, 211

[56] References Cited

U.S. PATENT DOCUMENTS

| | | | |
|---|---|---|---|
| 4,359,733 | 11/1982 | O'Neill | 342/36 |
| 4,608,656 | 8/1986 | Tanaka et al. | 364/449.6 |
| 5,122,959 | 6/1992 | Nathanson et al. | 364/436 |
| 5,170,353 | 12/1992 | Verstraete | 364/444 |
| 5,272,638 | 12/1993 | Martin et al. | 364/444 |
| 5,513,110 | 4/1996 | Fujita et al. | 364/449.1 |
| 5,543,789 | 8/1996 | Behr et al. | 340/995 |
| 5,602,564 | 2/1997 | Iwamura et al. | 345/119 |
| 5,628,050 | 5/1997 | McGraw et al. | 455/12.1 |

FOREIGN PATENT DOCUMENTS

| | | |
|---|---|---|
| 4-295995A | 10/1992 | Japan . |
| 5-327604A | 12/1993 | Japan . |
| 06338848 A | 12/1994 | Japan . |

*Primary Examiner*—Benjamin C. Lee
*Attorney, Agent, or Firm*—Frohwitter

[57] ABSTRACT

There is disclosed an information reporting system comprising a communication host apparatus including a database storing a plurality of data sets each concerning predetermined position, and a host computer, and at least one portable terminal including a data processing unit for executing predetermined processing based upon data received from a communication unit via a communication networks, and a display unit displaying images obtained by the data processing. The portable terminal further includes a current position detecting unit for detecting its current position, and is adapted to transmit position information data indicative of the current position. The host computer is responsive to read out from the database one of the data sets concerning the position corresponding to the provided position information data and supplies the portable terminal with the data set.

10 Claims, 8 Drawing Sheets

FIG. 3

| 301 DISASTER CLASSIFICATION | 302 SECOND TEXT INFORMATION |
|---|---|
| s1 | Smsg1 |
| s1 | Smsg2 |
| ⋮ | ⋮ |

FIG. 4

| 401 ROAD SECTION IDENTIFICATION NUMBER | 402 INTERSECTION POINT DATA | 402 INTERSECTION POINT DATA |
|---|---|---|
| L1 | c1 | c2 |
| L2 | c3 | c4 |
| ⋮ | ⋮ | ⋮ |

INFORMATION REPORTING SYSTEM

TECHNICAL FIELD

This invention is related to a communication system in which a host computer communicates various information to portable terminals. More specifically, it is related to an information reporting system which provides portable terminals with information suitable in light of circumstances at their locations.

BACKGROUND OF THE INVENTION

There are known techniques for enabling remote terminal apparatuses to utilize data processing functions, databases and the like of a host computer by connecting the host computer and the portable terminals via a communication network using dedicated lines, public telecommunication lines or the like. The portability of the terminal apparatuses is particularly enhanced when high mobility is achieved through connection for radio communication between the terminals and the host computer. Such apparatuses will be referred to as "portable terminals".

Current position calculating apparatuses for detecting the position of mobile units such as motor vehicles based upon information from satellites have recently become available. Systems with portable terminals equipped with such current position calculating apparatuses have been developed. For example, (1) Japanese Patent Application laid open No. 4-295995 discloses a system capable of transmitting position information provided by a navigation system through a telephone terminal to a predetermined receiving equipment, (2) Japanese Patent Application laid open No. 5-327604 discloses a system which automatically sends to a control office in control of a radio communication network information including data indicative of the current position of a mobile station at predetermined time intervals, and (3) Japanese Patent Application laid open No. 6-338848 discloses a system which transmits position information of a telecommunication device to an emergency information receiving center in case of emergency.

In these systems, however, the portable terminal, such as telecommunication devices, merely transmits information indicative of its position and the user of the portable terminal cannot obtain information related to the circumstances at his or her location.

For example, in case of disaster such as an earthquake or a fire, although the information on the position of the portable terminal is transmitted from the portable terminal to a message handling system or an emergency information receiving center at a police facility, the user is not supplied with appropriate information such as advice on taking refuge. He or she, therefore, cannot obtain important information regarding, for example, where to find a shelter at his or her location.

Even under ordinary circumstances there are likely to be times when the user would like to obtain proper information related to his or her location.

The object of the present invention is to provide an information reporting system which allows a user of a portable terminal to obtain information regarding circumstances at his of her current position.

SUMMARY OF THE INVENTION

The above and other objects of the present invention are accomplished by an information reporting system comprising a communication host apparatus including a database storing a plurality of data sets each concerning a predetermined position, and a host computer capable of accessing the database and connecting with the communication network, and at least one portable terminal including communication means capable of connecting with the communication network, data processing means for executing predetermined processing based upon data received through the communication means, and display means for displaying images based upon data obtained by the data processing, the portable terminal further including current position detecting means for detecting its current position and being adapted to cause the communication means to transmit the position information data indicative of the current position detected by the current position detecting means to the communication host apparatus via the communication network, and the host computer of the communication host apparatus being responsive to the position information data received from the portable terminal to retrieve from the database a data set concerning the position and supplying it to the portable terminal via the communication network.

According to the present invention, the position information data indicative of the current position of the portable terminal detected by the current position detecting means are supplied to the communication host apparatus by the communication means, and in response to the position information data the host computer of the communication host apparatus transmits appropriate data to the portable terminal. The data processing means executes predetermined data processing based upon the information received from the host computer, and the display means displays an image corresponding to data obtained by the data processing on the screen thereof. Consequently, the user of the portable terminal can obtain appropriate information regarding circumstances at his or her location.

In a preferred aspect of the present invention, the portable terminal further includes a timer which outputs a time-up signal at predetermined intervals, and the communication means is responsive to the time-up signal to transmit the position information data indicative of the current position of the portable terminal to the communication host apparatus.

According to this aspect of the invention, since the position information data are transmitted to the communication host apparatus at predetermined intervals, the user of the portable terminal can obtain appropriate information without any complicated input operation or the like.

In another preferred aspect of the present invention, the communication host apparatus is adapted to request that the communication means of the portable terminal be connected to a telecommunication circuit of the communication network, and the portable terminal is adapted to transmit the position information data indicative of the current position thereof after being connected to the telecommunication circuit in response to the request.

According to this aspect of the invention, since the position information data are transmitted when the communication host apparatus requests that the communication means of the portable terminal be connected to the telecommunication circuit, the user can, in an emergency or when otherwise necessary, obtain the appropriate information without any complicated input or the like.

In a further preferred aspect of the present invention, each of the data sets stored in the database includes disaster classification data indicative of disaster class, and one of the data sets including the disaster classification data is transmitted to the portable terminal.

In a still further preferred aspect of the present invention, each of the data sets stored in the database includes text data.

In a further preferred aspect of the present invention, each of the data sets stored in the database includes road section data for specifying a road on a map.

In a still further preferred aspect of the present invention, the road section data indicate at least one road which is impassable owing to a disaster.

In a further preferred aspect of the present invention, each of the data sets stored in the database includes route specifying data for specifying at least one route between two predetermined points on a map.

In a still further preferred aspect of the present invention, one end of the route corresponds to a position based upon the position information data indicative of the current position of the portable terminal.

In a further preferred aspect of the present invention, the route specifying data at least indicate a route toward a shelter appropriate in light of a disaster.

In a still further preferred aspect of the present invention, each data set concerning a particular position is associated with a particular area, and the host computer is adapted to determine, based upon the received position information data, which area the current position of the portable terminal falls within.

In a further preferred aspect of the present invention, the area corresponds to a substantially circular area of a predetermined radius whose center is a particular point. Alternatively, the area may be defined by two longitude lines and two latitude lines.

In a still further aspect of the present invention, the portable terminal includes a first database storing data items concerning disaster type for each disaster class, the data processing means reads out from the first database one of the data items corresponding to the disaster class received by the communication means, and the display means displays an image based upon the read-out data.

In a further aspect of the present invention, the portable terminal includes a second database storing map data, and the display means displays an image based upon the road section data and portions of the map data corresponding to a map of a predetermined area.

In a further aspect of the present invention, the portable terminal includes a second database storing map data, and the display means displays an image based upon the route specifying data and portions of the map data corresponding to a map of a predetermined area.

In another aspect of the present invention, each data set in the database includes geographic data concerning geographic features around the position, and one of the data sets including the geographic data is transmitted to the portable terminal.

In a further aspect of the present invention, each data set in the database includes weather data each concerning weather around the position, and one of the data sets including the weather data is transmitted to the portable terminal.

The above and other objects and features of the present invention will become apparent from the following description made with reference to the accompanying drawings.

BRIEF DESCRIPTION OF THE DRAWINGS

FIG. 3 is a schematic illustration showing the structure of a first database in accordance with the first embodiment;

FIG. 4 is a schematic illustration showing the structure of a second database in accordance with the first embodiment;

DESCRIPTION OF THE PREFERRED EMBODIMENTS

An information reporting system in accordance with a first embodiment of the present invention is configured to report information concerning a disaster such as an earthquake or a fire to users having portable terminals when the disaster occurs.

Figure 1:
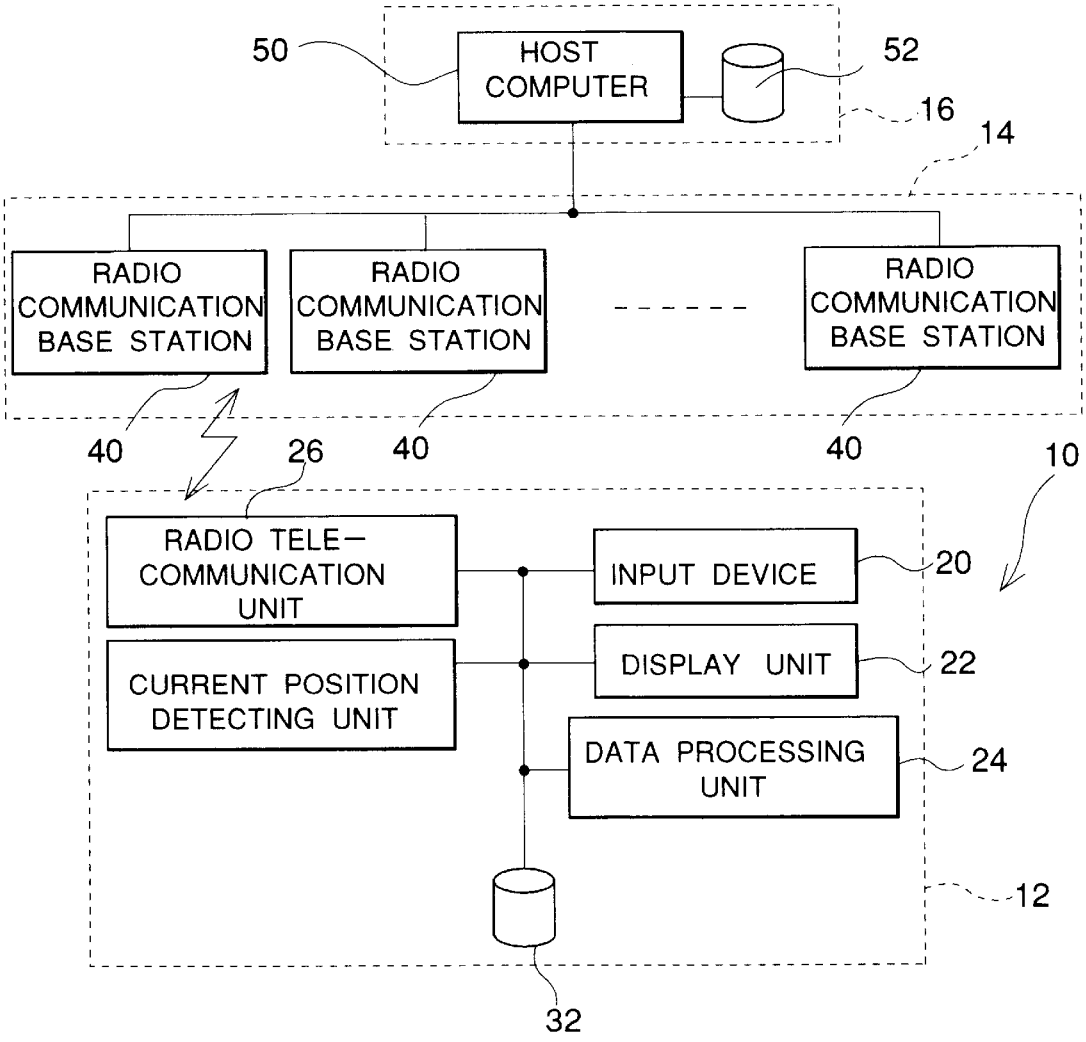
FIG. 1 is a block diagram of an information reporting system in accordance with a first embodiment of the present invention.

As shown in FIG. 1, the information reporting system 10 comprises a portable terminal 12, a communication network system 14, and a communication host apparatus 16. Although there are a plurality of portable terminals in the system, for simplicity, only a single portable terminal is shown in FIG. 1. The structures of the above mentioned elements will now be explained.

The portable terminal 12 comprises a input device 20 having a touch panel or the like for enabling the user to input desired information, a display unit 22 including a liquid crystal display panel, a data processing unit 24 including a data processing device such as a central processing unit (CPU) and a storage device such as a random access memory (RAM), a radio telecommunication unit 26 including a cellular terminal device, a personal handy phone system (PHS) terminal or the like for communication between it and a radio communication base station (described later) provided at the communication network system 14, a current position detecting unit 28 including a global positioning system (GPS) receiving device for detecting the current position of the portable terminal 12, and a database 32, constituted by a read only memory (ROM), an IC card or the like, which stores predetermined information. GPS is a system for detecting current position used by "a vehicle management apparatus" disclosed in Japanese Patent Application laid open No. 6-236211, and PHS is a radio telecommunication system of Nippon Telegraph and Telephone Corporation (NTT).

When a user touches the touch panel (not shown), the input device 20 detects the operation and provides the data processing unit 24 with instructions or data input by the user.

The display unit 22 displays on a display screen thereof images corresponding to the results of data processing by the data processing unit 24, data received by the radio telecommunication unit 26, or position information data indicative of the current position detected by the current position detecting unit 28.

And The data processing unit 24 executes predetermined types of data processing including retrieval from the database 32 based upon data or instructions received from the input device 20, the received data or the position information data as described above. In addition, the data processing unit 24 provides the radio telecommunication unit 26 with the position information data indicative of the current position detected by the current position detecting unit 28. In this embodiment, the data processing unit 24 outputs the position information data or the like to the radio telecommunication unit 26 when it has received a signal indicating completion of connection to a circuit line from the radio telecommunication unit 26.

The radio telecommunication unit 26 establishes the connection to the radio circuit line when it has received a signal requesting connection with the circuit line from the outside via radio telecommunication. The radio telecommunication unit 26 sends to the data processing unit 24 a signal indicating completion of connection to the circuit line. The radio telecommunication unit 26 then transmits the current position data from the data processing unit 24 via the connected circuit line.

The current position detecting unit 28 receives a signal from an artificial satellite, generates position information data indicative of the current position of the portable terminal based on the signal and sends the data to the data processing unit 24.

The database 32 is arranged to enable the desired data stored therein to be retrieved by the execution of retrieval processing by the data processing unit 24.

The communication network system 14 will now be explained.

The communication network system 14 comprises a plurality of radio communication base stations 40 such as cellular base stations or PHS base stations. Each of the radio communication base stations 40 is adapted to receive a signal emitted from the radio telecommunication unit 26 in the portable terminal 12 when it is within a predetermined distance thereof, and to transfer the received signal to the communication host apparatus 16 via a telecommunication circuit 42. Since the distance over which circuit lines can be established using radio telecommunication is limited in this embodiment, the plurality of radio communication base stations 40 are spaced at predetermined intervals so as to expand the overall area within which signals from the portable terminal 12 can be received.

The communication host apparatus 16 will now be explained.

The communication host apparatus 16 comprises a host computer 50 connected to the communication network system 14 via the telecommunication circuit 42, and a database 52 connected to the host computer 50.

The host computer 50 transmits/receives data to/from the portable terminal 12 via the communication network system 14, retrieves predetermined data from the database 52 based upon the position information data received from the portable terminal 12 and writes appropriate data to the database 52.

The database 52 will now be more specifically explained. The database 52 may be at a different location from the host computer 50 and be connected to the host computer 50 via another communication network. In addition, the host computer 50 may be connected to the communication network system 14 via other network such as a Local Area Network (LAN).

Figure 2:
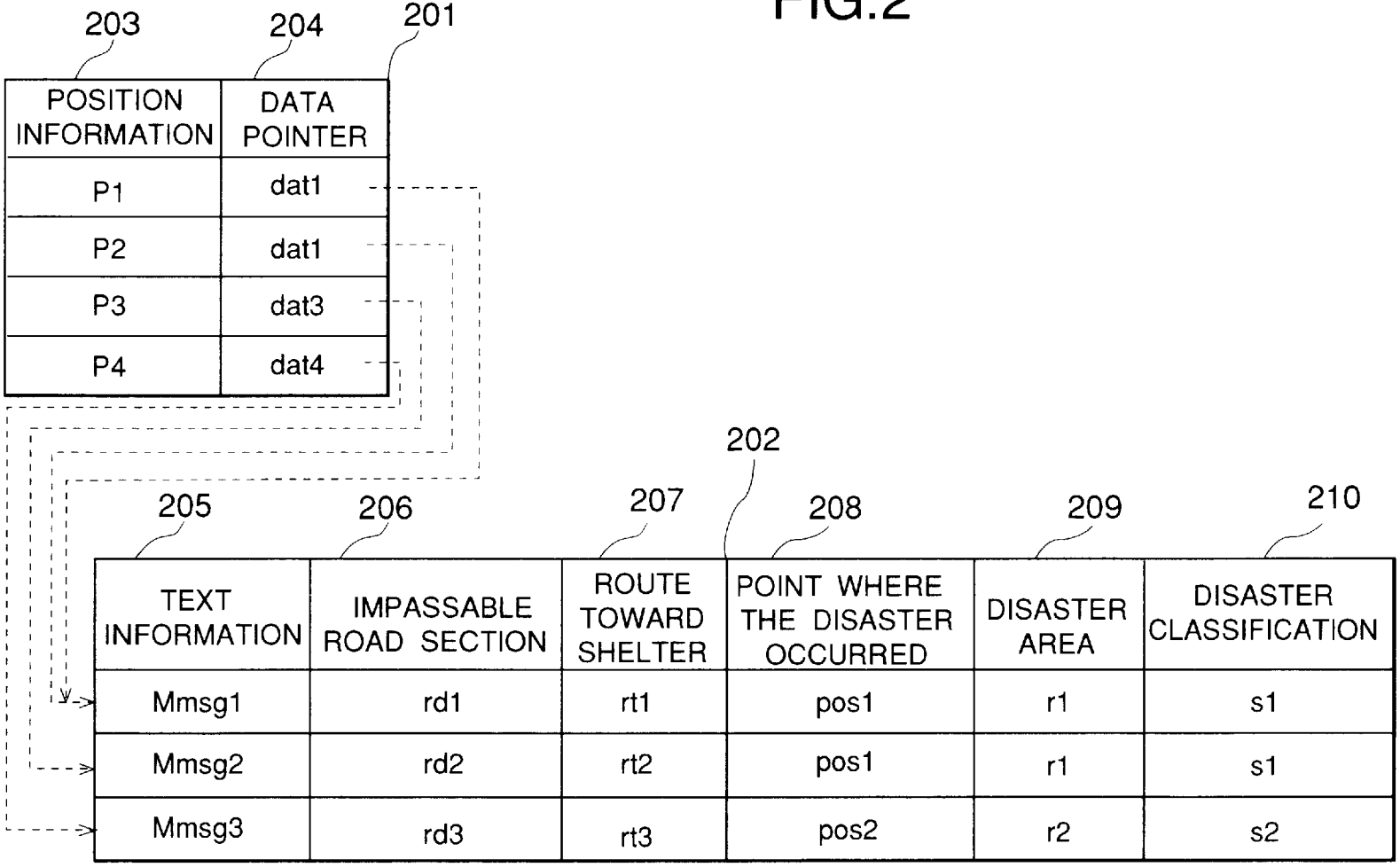
FIG. 2 is a schematic illustration showing the structure of a data base in a communication host apparatus in accordance with the first embodiment.

FIG. 2 shows the data structure of the database 52 in this embodiment. As shown in FIG. 2, in this embodiment the database 52 stores position information data corresponding to current positions of the portable terminal 12 and disaster information data to be reported to the user of a portable terminal 12 who is at the position concerned upon occurrence of a disaster.

The database 52 comprises a retrieval key table 201 including a list of retrieval keys and a retrieval data table 202 which is data sets to be retrieved.

The retrieval key table 201 includes a list of the position information data 203, which are the retrieval keys, and retrieval data pointers 204 each indicating a storage position of a retrieval data set corresponding to one item of the position information data 203. In this embodiment, one item of the position information data 203 comprises data indicative of an area defined by two longitude lines and two latitude lines. Alternatively, each item of the position information data 203 may comprise data concerning a longitude range and a latitude range, data indicative of a center and a radius for defining a substantially circular area on a map, or data concerning a number of a particular area such as an administrative district (e.g. city, town, village). Alternatively, each item of the position information data item may comprise data indicative of a single point such as an intersection of longitude and latitude lines, or an identification number specifying a particular point on a map.

The retrieval data pointer 204 indicates one of the data sets in the retrieval data table 202, and comprises data numbers each indicating one of the data sets. Alternatively, the retrieval data pointer 204 may comprise addresses of a memory which stores the data sets. In this way, the data pointers 204 associate each item of the position information data 203 with a data set stored in the retrieval data table 202.

In addition, an item of the position information data 203 may have the same retrieval data pointer value as another item thereof, whereby they may correspond to the same data set.

The retrieval data table 202 comprises the plurality of data sets, each including text information data 205 including disaster news indicative of the kind of disaster which occurred, the scale of the disaster and the like, impassable road section information data 206 which indicate road sections which have become impassable due to the disaster, shelter route information data 207 indicative of routes toward a predetermined shelter, disaster point information data 208 indicative of the point where the disaster occurred, disaster area information data 209 which indicate the area affected by the disaster, and disaster classification information data 210 indicative of the kind of disaster such as an earth quake or a fire. As mentioned above, the retrieval data sets can be specified by the data pointer.

The text information data 205 includes character code data consisting of JIS (Japan Industrial Standard) codes. Alternatively, the system may comprise another database storing a plurality of character code data sets so that the text information data item 205 is associated with one of the addresses of the character code data sets so as to designate character codes.

The impassable road section information data 206 include road section identification numbers used for designating road sections which have become impassable. Alternatively, the impassable road section information data 206 may include positions of end points between which the roads are impassable. Further, if a plurality of road sections have become impassable, one impassable road section information data item 206 includes the plurality of road section identification numbers.

The shelter route information data 207 include data concerning the routes toward the shelter appropriate in light of the disaster. For example, one data item corresponds to one or more road section identification numbers indicative of road sections constituting the route toward the shelter. Alternatively, the shelter route information data 207 may be position data indicative of a plurality of predetermined points on the routes toward the shelter. Further, if a plurality of routes toward the shelter exist, one data item may include a plurality of road section identification numbers for each route.

The disaster point information data 208 include data indicative of the longitude and latitude of the point where the disaster occurred. Alternatively, the disaster point information data 208 may include position data indicative of particular points on a map such as identification numbers.

The disaster area information data 209 indicate areas affected by the disaster. In this embodiment, for example, the disaster area information data 209 include data concerning pairs of the longitude and latitude ranges each pair defining an area. Alternatively, the disaster area information data 209 may include data indicative of the radii of circles whose centers coincide with points identified by the disaster point information data 208, or identification number data indicative of administration districts such as cities, towns, villages or the like affected by the disaster.

The disaster classification information data 210 include disaster identification numbers which indicate the kind of disaster, such as an earthquake, a tidal wave, an explosion, pollution. Regarding earthquake, in this embodiment values corresponding to the magnitude of the earth quake and the district where it occurred (bay area, mountainous district etc.) are assigned to the disaster identification numbers. Further, regarding pollution, different values in accordance with the pollution level, and regarding fire, different values in accordance with a scale of the fire, are assigned to the disaster identification number. The above mentioned features allow the kind of disaster to be more specifically identified.

As mentioned above, the retrieval data table 202 includes the plurality of retrieval data sets corresponded to the position information data 203, and each of the retrieval data sets includes various information data 205 to 210 concerning the disaster.

The structure of the database 32 provided in the portable terminal 12 will now be explained. The database 32 includes a first database, a second database and a map database containing map data. The map database may be installed in the portable terminal or may be provided in an external storage medium such as a CD-ROM, a memory card. First, the first database will be explained.

The first database stores predetermined information corresponding to disaster classification data described later. FIG. 3 shows a structure of the first data base. As shown in FIG. 3, the first database includes disaster classification information data 301 and second text information data 302, each item of which corresponds to an item of the disaster classification information data 301.

The disaster classification information data 301 correspond to the disaster classification information data 210 stored in the retrieval data table 202 of the database 52 shown in FIG. 2. Namely, the disaster classification information data 301 are provided such that the items thereof are the same as those of the disaster classification information data 210 in the retrieval data table 202.

The second text information data 302 include text information, such as character code data consisting of JIS code sets corresponding to each item of the disaster classification information data 301. For example, if the data value of the disaster classification information data 301 indicates a fire of a particular scale, the second text information data 302 might consist of data indicating that "the area within a radius 500 meters of the point where the fire occurred is dangerous." Further, if the data value thereof indicates an earthquake of a particular magnitude in a mountainous district, or if the data value thereof indicates another earthquake of another magnitude in a bay area, the second text information data 302 consist of data indicating that "a landslide or a rock slide may occur" or "a tidal wave may occur."

The structure of the second database will now be explained. The second database is provided in order to display an appropriate road map on the screen of the display unit 22 of the portable terminal 12. FIG. 4 shows the structure of the second database. As shown in FIG. 4, the second database includes road identification number information data 401 and intersection position data 402, 403 indicative of the positions of two intersections of the road corresponding to the road identification number. The road identification number information data 401 include road section identification numbers which are the same as those contained in the impassable road section information data 206 in the retrieval data table 202. Namely, if the road section identification number contained in the impassable road section information data 206 coincides with that contained in the road identification number information data 401, both of them designate the same road.

Further, the intersection position data 402, 403 indicate the coordinates of the end points of the road sections identified by the road identification numbers 401 in the map corresponding to the map data.

Figure 5A:
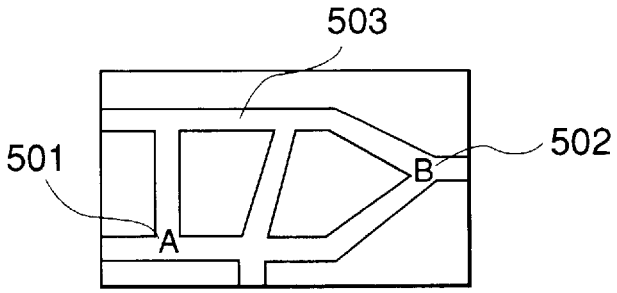
FIGS. 5A, 5B and 5C are schematic illustrations for explaining the structure of the second database and a map with roads displayed based thereon.
Figure 5B:
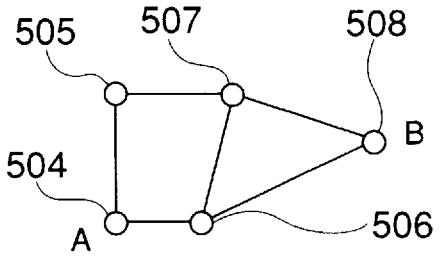
Figure 5C:
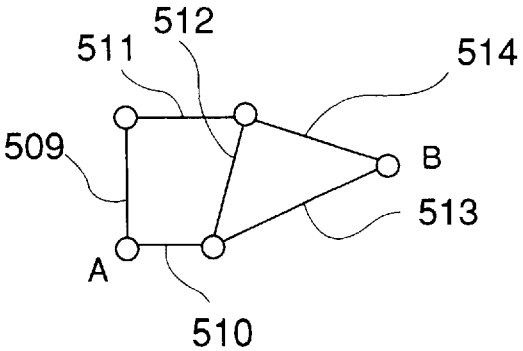

The structure of the second database and the map with roads displayed based thereon will be more specifically explained with reference to FIGS. 5A to 5C. FIG. 5A is a road map based upon the map data, which is displayed on the screen of the display unit 22 of the portable terminal 12. In FIG. 5A, the numeral 503 designates a particular road. FIGS. 5B and 5C show the above mentioned road using a network in which intersections are defined as nodes and road sections between adjacent intersections are defined as links. For example, as shown in FIG. 5B, the intersections are represented by nodes 504 to 508, while, as shown in FIG. 5C, the road sections are represented by links 509 to 514. In view of the above, the intersections A 501 and B 502 correspond to the nodes 504 and 508, while the road 503 corresponds to the link 511 between the nodes 505 and 507.

Assume that the road section number L1 is assigned to the road corresponding to the link 511. By storing in the database the position data c1 and c2 indicative of the positions of the respective nodes 505 and 507, the appropriate road 503 (corresponding to the link 511) can be specified on the screen of the display unit 22 based upon the position data c1 and c2.

The operation of the thus constructed information reporting system 10 will now be explained.

If an earthquake or a fire occurs, the various information shown in FIG. 2 is stored in the database 52 of the communication host apparatus 16. This is accomplished by arranging for the various data to be automatically generated from information concerning the disaster collected by the police, fire department, weather bureau, government offices and the like by another program executed by the host computer 50 and stored in the database 52. Alternatively, it may be accomplished by having an operator of the host computer 50 operate an input device (not shown) to store the appropriate data in the data base 52. After the appropriate information is stored to the database 52 as described above, the communication host apparatus 16 attempts to connect with the portable terminal 12 via the communication network system 14. The subsequent operation of the communication host apparatus 16 will be described later.

Figure 6:
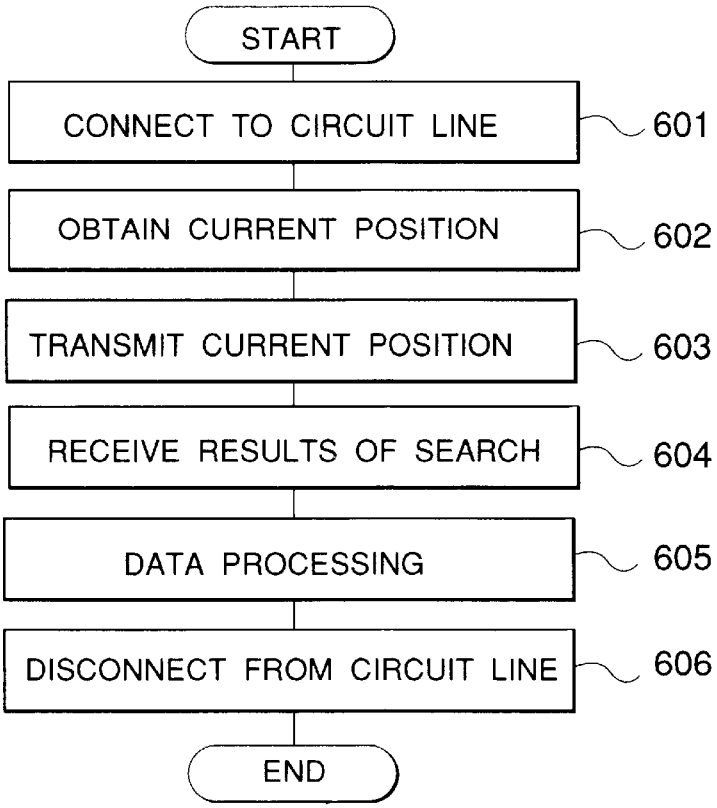
FIG. 6 is a flowchart showing processing in a portable terminal 12 in accordance with the first embodiment.

The operation of the portable terminal 12 will now be explained. FIG. 6 is a flowchart showing the processing operations of the portable terminal 12 in accordance with this embodiment.

When the radio telecommunication unit 26 receives an instruction to connect with the host computer 50 from a particular radio communication base station 40, it establishes a telecommunication circuit between the portable terminal 12 and the host computer 50 via the radio communication base station 40, and after completion of the connection, it sends a signal indicating that the circuit has been established to the data processing unit 24 (STEP 601).

Next, the current position detecting unit 28 receives a radio signal from the GPS satellite and provides the data processing unit 24 with position information data indicative of the current position of the portable terminal 12 detected based on the signal (STEP 602). The data processing unit 24 provides the radio telecommunication unit 26 with the received position information data, and in response thereto, the radio telecommunication unit 26 transmits the position information data, as well as ID number data for identifying itself, to the host computer 50 via the appropriate radio telecommunication base station 40 of the communication network system 14 (STEP 603). After the processing of STEP 603 has been executed, the portable terminal 12 transmits or receives other data than the position information data, or data in response to the position information data and obtained from the communication host apparatus 16 until it receives information from the communication host apparatus 16 as described later.

Figure 7:
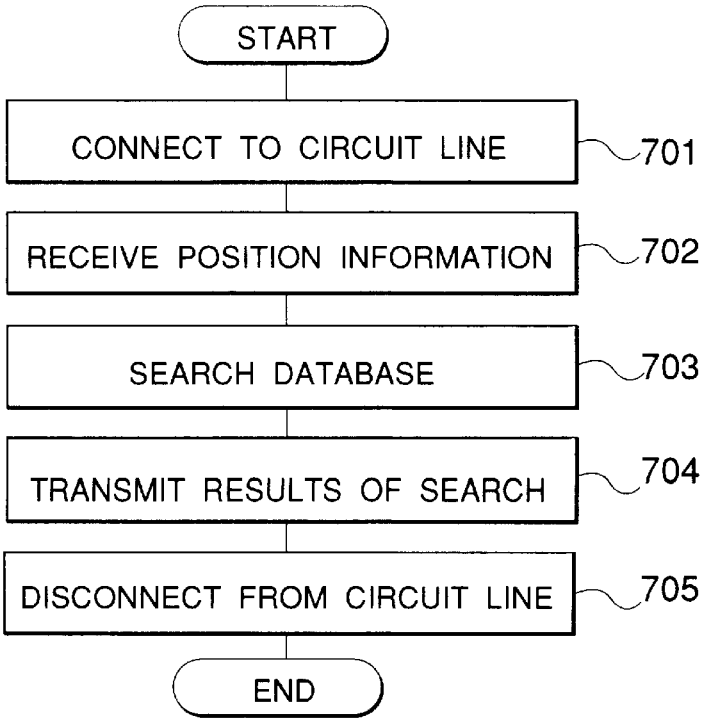
FIG. 7 is a flowchart showing processing in the communication host apparatus 16 in accordance with the first embodiment.

FIG. 7 is a flowchart showing the processing operation of the communication host apparatus 16. After the communication host apparatus 16 has established a connection to the appropriate portable terminal 12 via the communication network system 14 (STEP 701) as mentioned above and received the position information data from the portable terminal 12 (STEP 702), it refers to the retrieval key table 201 in the database 52 to determine the longitude and latitude ranges defining an area in which the position corresponding to the received position information data falls, namely, one item of the position information data 203 to read out the appropriate retrieval data set based upon the data pointer corresponding thereto (STEP 703). Assuming that the data value of the position information data of the portable terminal 12 falls within the range "p1" shown in FIG. 2, the data set corresponding thereto, including the text information data Mmsg1, the impassable road section information data rd1, the shelter route information data rt1, the disaster point information data pos1, the disaster area information data r1 and the disaster classification information data s1 is read out.

The host computer 50 then transmits to the appropriate portable terminal 12 via the communication network system 40 the retrieval data set including the text information data 205 to the disaster classification information data 210 read out in STEP 703 (STEP 704), and thereafter disconnects from the telecommunication circuit (STEP 705) to conclude the processing.

After the radio telecommunication unit 26 of the portable terminal 12 has received the retrieval data set via the communication network system 14, it provides the data processing unit 24 with the data set (STEP 604). Then, the data processing unit 24 executes the data processing based upon the received retrieval data set (STEP 605). More specifically, the data processing unit 24 reads out the second text information data 302 from the first database in the database 32, based upon the disaster classification information data 210 in the retrieval data set. Assuming that the data value of disaster classification data contained in the received retrieval data set is s1, the related second text information data Smsg1 are read out. Furthermore, the first text information data 205 contained in the retrieval data set and the read-out second text information data 302 are output to the display unit 22.

Further, the data processing unit 24 refers to the position information data indicative of its own current position of the portable terminal 12, the disaster point information data 208 and the like to specify an area in the map to be displayed on the screen of the display unit 22 so as to read out appropriate map data from the map database. Furthermore, the data processing unit 24 retrieves the data in the second database of the database 32 based upon the impassable road section information data 206 to obtain the intersection position data 402, 403 in association with the road identification number contained in the impassable road section information data 206, and searches the data in the second database of the database 32 based upon the shelter route information data 207 to obtain the intersection position data 402, 403 in association with the road identification number contained in the shelter route information data 207.

The thus obtained map data of the appropriate area, the intersection position data in association with the impassable road section information data, and the intersection position data in association with the shelter route information data are supplied to the display unit 22.

Based upon the supplied first and second text information data, the display unit 22 displays on the screen thereof a text corresponding to the text information data, and, based upon the supplied intersection position data, displays on the screen thereof an image of a map in which the impassable road sections and the route toward the shelter are specified. In this embodiment, in the map displayed on the screen of the display unit 22, one end of the route towards the shelter is assigned to the current position of the portable terminal or position near thereto based of the shelter route information data 207. As a result the user of the portable terminal 12 can more easily understand the route towards the shelter.

Figure 8:
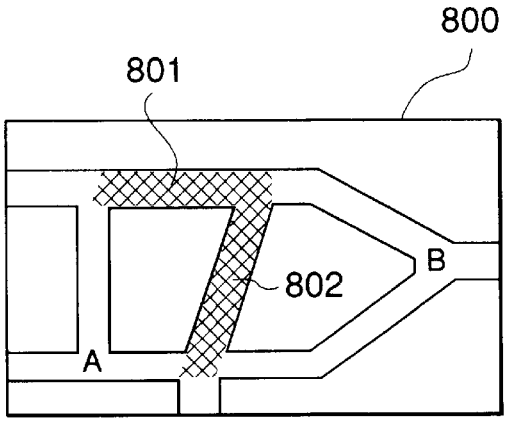
FIG. 8 is an illustration showing an image displayed on a screen of a display unit.

Assume that the fact that the roads corresponding to the links 511 and 512 in FIG. 5C are impassable is ascertained from the impassable road section information data. The sets of nodes 505, 507 and 506, 507, each set indicating opposite ends of a link, are obtained. As a result, an image 800 in FIG. 8 is produced on the screen of the display unit 22. In FIG. 8, road 801 and 802 marked with hatching are impassable.

After the completion of the above mentioned processing, the radio telecommunication unit 26 disconnects from the communication host apparatus 16 (STEP 606).

In this connection, the host computer 50 of the communication host apparatus 16 updates the contents of the database 52 based upon new information concerning the disaster. This may be accomplished by arranging for new data to be automatically generated and stored in the predetermined area of the database 52. Alternatively, it may be accomplished by having the operator of the host computer 50 operate an input device to store the appropriate data.

According to this embodiment, when a disaster occurs, the communication host apparatus 16 requests the portable terminal 16 to connect with the circuit line, and when the telecommunication circuit between the communication host apparatus and the portable terminal 12 is established, the position information data indicative of the current position of the portable terminal 12 are transferred to the communication host apparatus 16. The communication host apparatus 16 provides the portable terminal 12 with suitable information for the current position of the portable terminal. As a result, the provided information is displayed on the screen of the display unit 22. Consequently, the user of the portable terminal 12 can obtain appropriate information without complicated operations.

Further, according to this embodiment, since the host computer 50 transfers the data set including the text information data, the impassable road section data and the like to the portable terminal, the user of the portable terminal can specifically and definitely grasp the situation caused by the disaster.

Figure 9:
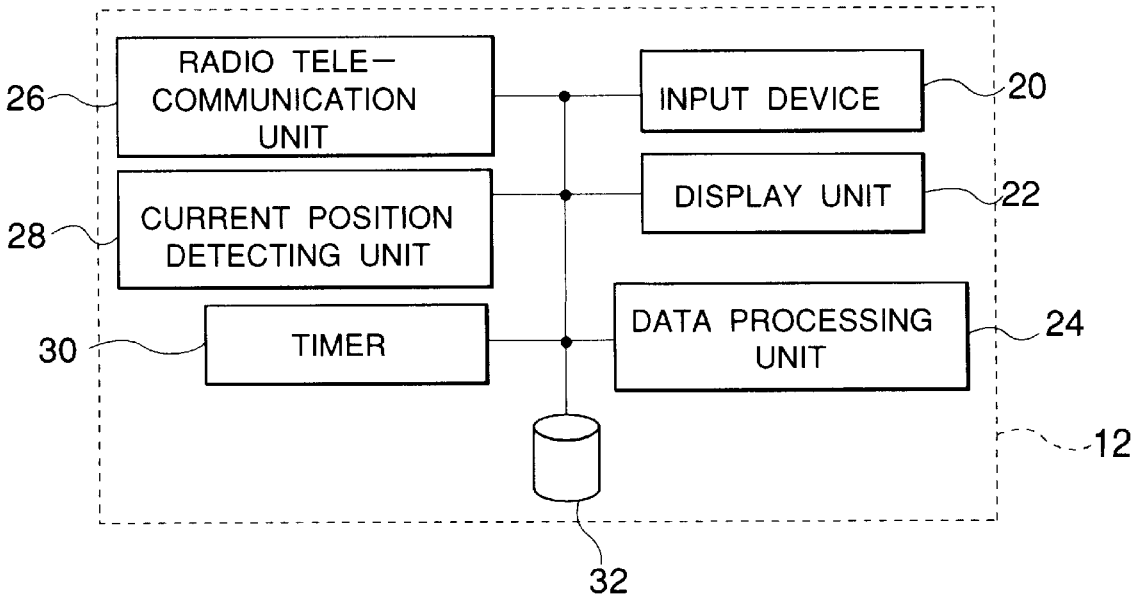
FIG. 9 is a block diagram of an information reporting system in accordance with a second embodiment of the present invention.

An information reporting system according to a second embodiment of the present invention will now be explained. The elements of the second embodiment are the same as those of the first embodiment except for a portable terminal 12. The features of the portable terminal 12 are shown in FIG. 9. As shown in FIG. 9, the portable terminal 12 comprises, in addition to the features provided in the portable terminal of the first embodiment, a timer 30 including a clock or the like. The timer 30 send a time-up signal to a data processing unit 24 when a predetermined time has passed. The user can change the time interval at which the timer 30 outputs the time-up signal by entering a new interval through the input device 20.

The structures of the various of databases are the same as those of the first embodiment shown in FIGS. 2 to 4.

The operation of the thus constructed information reporting system in accordance with the second embodiment will now be explained. Various information shown in FIG. 2 is stored in a database 52 of a communication host apparatus 16 when an earthquake, a fire or the like occurs.

Figure 10:
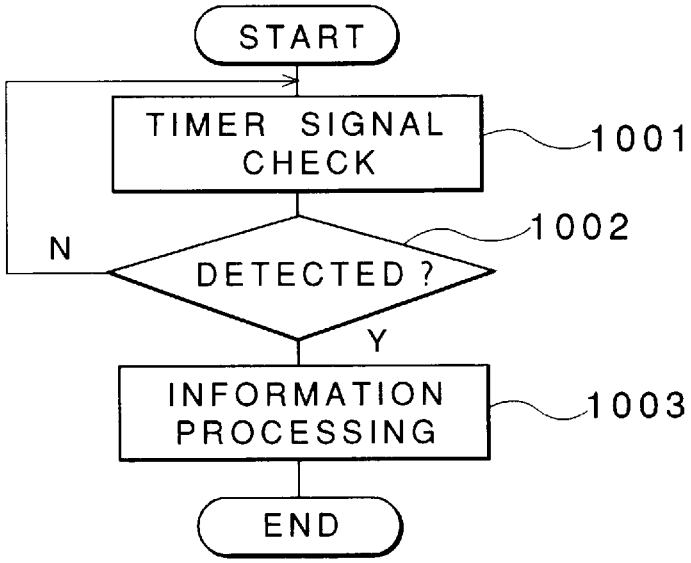
FIG. 10 is a flowchart showing processing in a portable terminal 12 in accordance with the second embodiment.

FIG. 10 is a flowchart of the portable terminal 12 in accordance with the second embodiment. As described above, the timer 30 outputs the time-up signal to the data processing unit 24 at predetermined intervals of a length designated by the user through the input device 20. The processing unit 24 checks whether or not a time-up signal has been output by the timer 30 (STEP 1001). If the processing unit 24 determines that a time-up signal was output (i.e. the result is "Yes" in STEP 1002), the program proceeds to STEP 1003 in which the appropriate processing is conducted. On the other hand, when the result is "No" in STEP 1002, the program returns to STEP 1001.

The processing in STEP 1003 is substantially the same as that shown in FIG. 6. Namely, the portable terminal 12 establishes a telecommunication circuit to the communication host apparatus 16 via the communication network system 14, and transfers the position information data to the communication host apparatus 16. It then receives appropriate information from the host computer 50 of the communication host apparatus 16 is received and conducts appropriate data processing based thereon.

Consider the case where no disaster has occurred, so that no information is stored in the database 52, or where information was once stored in the database but no new information has been stored since the last transmission to the portable terminal 12, in the second embodiment, the host computer 50 of the communication host apparatus 16 ascertains the situation from the position information data received from the portable terminal 12 via the communication network system 14 and sends to the portable terminal 12 data indicating that no change occurred in the information. The portable terminal receiving such data disconnects from the telecommunication circuit between it and the communication host apparatus without executing new data processing.

According to this embodiment, the portable terminal 12 supplies the communication host apparatus 16 with position information data indicative of the current position of the portable terminal via the communication network system 14 at regular fixed intervals, and the host computer 50 of the communication host apparatus 16 transfers necessary information to the portable terminal 12 in predetermined cases. Accordingly, the host computer 50 need not instruct the portable terminal 12 to establish a telecommunication circuit. As a result, the load on the host computer 50 can be reduced, particularly in cases where it is required to transfer/receive information to/from multiple portable terminals 12.

Figure 11:
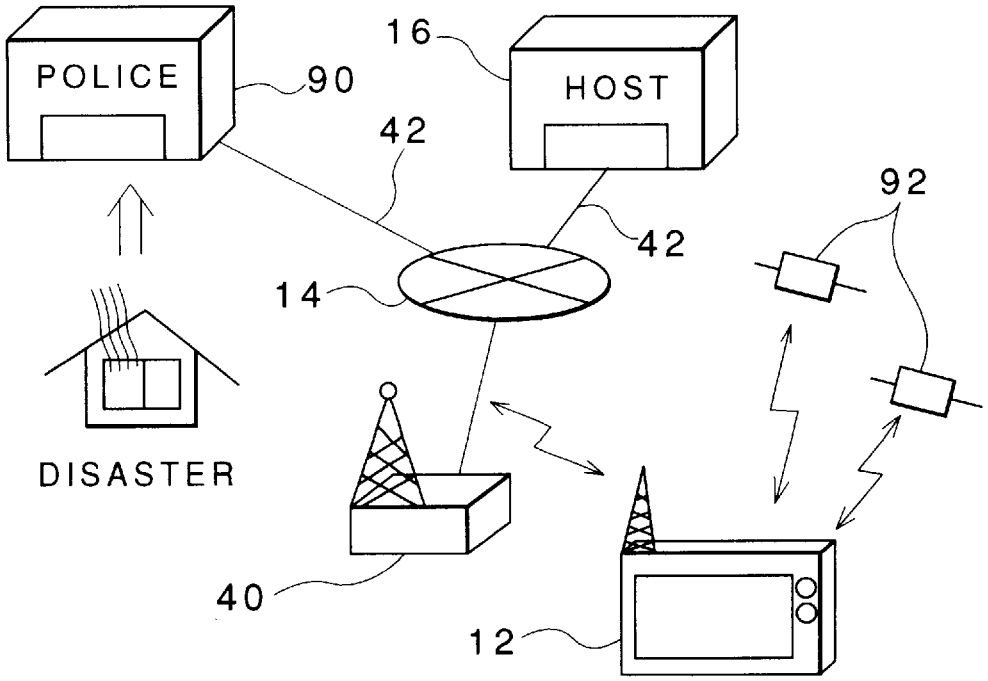
FIG. 11 is an illustration of a system to which the present invention is applied.

An application of these embodiments of the present invention will be explained with reference to FIG. 11. When a disaster such as a fire occurs, a computer (not shown) at the police department or other facilities 90 responsible for responding to disasters transfers disaster information data to the communication host apparatus 16 via the telecommunication circuit 42.

After the host computer 50 of the communication host apparatus 16 (see FIG. 1) receives the disaster information data, it updates the contents of the database 52 based on the received information. When possible, the communication host apparatus 16 is preferably provided at the facility 90 in charge of disaster response because this makes it possible to save the time otherwise required for transferring/receiving information to/from the facility.

On the other hand, the portable terminal 12 determines its current position by GPS using signals from satellites 92 and sends the position information data to the communication host apparatus 16 via a radio communication base station 40 and the telecommunication network 42. In this application, the processing for transferring the position information data can be accomplished by the portable terminal 12 without any operation by the user to get the information, when the telecommunication circuit is established by a request of the host computer 50 of the communication host apparatus 16 or when a predetermined time has passed. The position information data are transferred via the radio communication base station 40 and the telecommunication circuit 42 to the communication host apparatus 16.

The host computer 50 of the communication host apparatus 16 uses the received position information data as a retrieval key to retrieve data from a database 52 (see FIG. 1). The retrieval data set including disaster classification data, impossible road section information data and the like obtained as a result of the retrieval is transferred to the portable terminal 12 from the communication host apparatus 16 via the telecommunication circuit 42 and the radio communication base station 40. As a result, the user of the portable terminal 12 can obtain information on the disaster suitable for his or her current position without conducting any operation to obtain the information.

Figure 12:
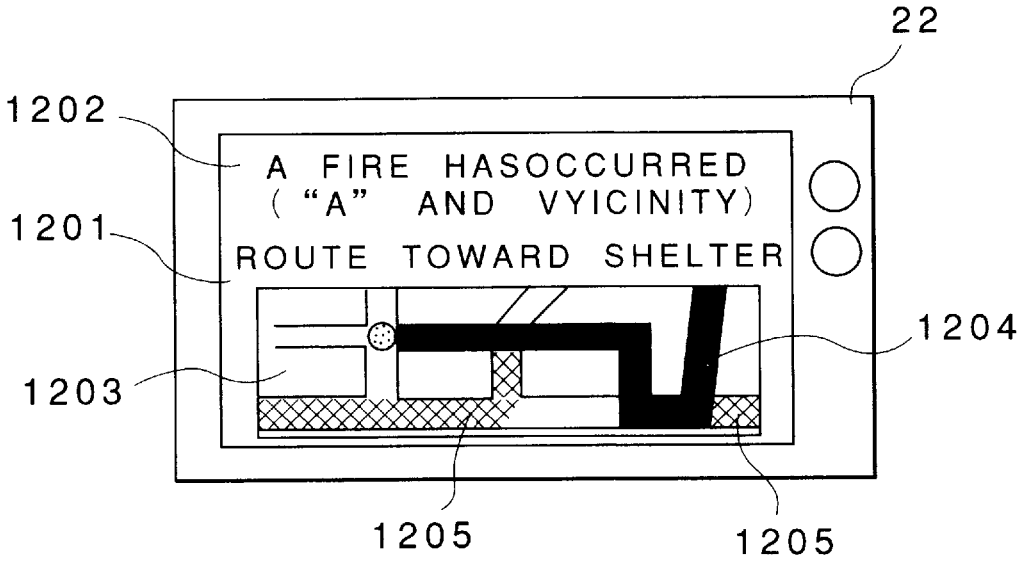
FIG. 12 is an illustration showing an image displayed on a screen of a display unit in the system of FIG. 11.

FIG. 12 is an illustration showing the screen of a display unit 22 displaying an image based upon the information received by the portable terminal 12. As shown, the screen 1201 of the display unit 22 displays an image including a text 1202 based upon the text information data received from the communication host apparatus 16, and a map 1203 including a route 1204 toward a shelter highlighted in black and an impassable road 1205 designated by hatching.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, the retrieval data set in the database 52 provided in the communication host apparatus 16 includes the text information data 205, the impassable road section information data 206, the shelter route information data 207, the disaster point information data 208, the disaster area information data 209 and the disaster classification information data 210, and the host computer 50 transmits these data to the portable terminal 12. This invention, however, is not limited to this arrangement, and it is possible to transmit portions of the above mentioned data as the retrieval data set.

Assume that the portable terminal sent at least the disaster area information data and the disaster classification information data. In the portable terminal, information of a general nature useful in conjunction with the disaster area information data or the disaster classification information data is stored in the first database in advance. Such general purpose information would include data indicating that "roads and railways within the area may be impassable," which is to be read out when the area affected by the disaster is larger than a particular area defined by predetermined longitude and latitude ranges. With the above mentioned arrangement, the portable terminal can generate suitable data, while reducing the quantity of data transmitted from the host computer 50 to the portable terminal, namely reducing the communication time therebetween, so as to display appropriate information on the screen of the display unit 22.

Alternatively, the first database may store road control information data for specifying roads which are likely to be impassible when a disaster occurs, each item thereof corresponding to one item of the disaster classification information data. For example, the road control information data might include data indicating that "roads narrower than 3.5 m are impassable" in response to an item of the disaster classification information data indicating an earthquake of above a predetermined magnitude.

Further, in the above described embodiments, the first database is provided in the database 32 of the portable terminal 12, and the appropriate second text information data are read out from the first database in accordance with the disaster classification information data provided by the communication host apparatus 16 so as to display a text or the like based thereon on the screen of the display unit 22. However, if the communication host apparatus 16 specifically supplies the retrieval data set including the first text information data 205, it is not necessary to provide the first database in the database 32.

Furthermore, although in the above described embodiments, the portable terminal 12 comprises the map database, the invention is not limited to this arrangement, and instead, the communication host apparatus may transmit map data in accordance with the current position of the portable terminal.

Moreover, although in the above described embodiments, the portable terminal transmits the position information data indicative of its current position in response to the request for connection from the communication host apparatus or when a predetermined time has passed, the invention is not limited to this arrangement, and instead, the system can be configured so that the user of the portable terminal can transmit the position information data by operating the input device and the communication host apparatus responds by providing the portable terminal with the appropriate information.

Further, although in the above described embodiments, when a disaster occurs, the portable terminal is sent appropriate data in response to the position information data indicative of its current position, this invention is not limited to this arrangement, it is instead possible to have the communication host apparatus send the portable terminal information appropriate in light of the current position of the portable terminal in specified cases. Possible arrangements include (1) a system configured to send the portable terminal auxiliary information concerning geographical features around its current position, and (2) a system configured to provide the portable terminal with information regarding the weather at its current position.

In the aspect (1), the database 52 of the communication host apparatus 16 is supplied, in advance, with retrieval data sets each including image data indicative of a map for a predetermined area, and/or guidance information including an accommodations list, a restaurant list, a list of refugees going, sightseeing or the like. If the portable terminal 12 transmits the position information data indicative of the current position when the predetermined time has passed, the host computer 50 of the communication host apparatus 16 reads out from the database 52 the appropriate retrieval data set based upon the received position information data and transmits the data set to the portable terminal 12.

According to this aspect, since the information to be supplied is stored in the database 52 of the communication host apparatus 16, it is possible to update the information easily. For example, regarding the accommodations list, it is possible to report new information to the user of the portable terminal by updating information on vacant rooms and the like in real-time.

Further, according to this aspect, since the information stored in the database of the communication host apparatus is updated, a plurality of portable terminals can be provided with new and appropriate information. The user of the portable terminal therefore need not buy a recorded medium such as a CD-ROM storing a predetermined information.

In the aspect (2), the database 52 of the communication host apparatus 16 stores retrieval data sets each consisting of weather information including a weather forecast, temperature, wind force velocity and wave height for a predetermined area. When the portable terminal 12 transmits the position information data indicative of the current position after the predetermined time has passed, the host computer 50 of the communication host apparatus 16 reads from the database 52 the appropriate retrieval data set based upon the received position information data and transmits it to the portable terminal 12.

According to this aspect, since the user of the portable terminal can obtain weather information for the current position of the portable terminal at predetermined intervals, he or she can easily learn of changes in the weather, whether or not a warning has been announced and the like.

Furthermore, in the present invention, the respective means need not necessarily be physical means and arrangements whereby the function of the respective means is accomplished by software fall within the scope of the present invention. In addition, the function of a single means may be accomplished by two or more physical means and the function of two or more means may be accomplished by a single physical means.

According to the present invention, it is possible to provide an information reporting system which allows a user of a portable terminal to obtain information relating to circumstances at his or her current position.

We claim:

1. An information reporting system comprising:

a communication host apparatus including a database storing a plurality of data sets each concerning a predetermined position and a host computer capable of accessing said database and connecting with a radio telephone communication line; and at least one portable terminal including communication means capable of connecting with the radio telephone communication line, data processing means for executing a predetermined data processing based upon data received from said communication means, and display means for displaying images based upon data obtained by said data processing means;

wherein said portable terminal further comprises a current position detecting means for detecting its current position and is adapted to cause the radio telephone communication line to be connected to said host computer in response to a request from said host computer for connection to the radio telephone communication line and also to cause said communication means to transmit position information indicative of the current position of said portable terminal to said communication host apparatus, and when data set including disaster classification data indicative of disaster class is stored in said database, as one of said data sets to be stored in said database, said host computer of the communication host apparatus is adapted to request said communication means of said portable terminal to be connected to the radio telephone communication line to receive said position information data transmitted from said portable terminal, and when the position indicated by said position information is relative to the disaster occurred, said host computer is adapted to transmit data set corresponding to the disaster to said portable terminal and cut off the radio telephone communication line after the transmission wherein said transmitted data set includes route specifying data for directing the portable terminal from its current position to a designated shelter location associated with said disaster classification data when said host computer apparatus considers such direction appropriate with respect to said disaster.

2. An information reporting system in accordance with claim 1, wherein said portable terminal includes a first database storing data items concerning disaster type for each disaster class, said data processing means reads out from said first database one of the data items corresponding to the disaster class received by said communication means, and said display means displays an image based upon the read-out data.

3. An information reporting system according to claim 1, wherein said portable terminal further includes a timer which outputs a time-up signal at predetermined intervals, and said communication means is responsive to the time-up signal to transmit the position information data indicative of the current position of the portable terminal to said communication host apparatus, and said host computer of the communication host apparatus is adapted to retrieve from the database a data set concerning the position indicated by the position information transmitted from said portable terminal, and to supply the data set to said portable terminal, if the data set concerning the position is retrieved.

4. An information reporting system in accordance with claim 1, each of said data sets stored in said database including road section data for specifying a road in a map.

5. An information reporting system in accordance with claim 4, said road section data indicating at least one road which is impassable owing to a disaster.

6. An information reporting system in accordance with claim 4, wherein said portable terminal includes a second database storing map data, and said display means displays an image based upon said road section data and portions of said map data corresponding to a map of a predetermined area.

7. An information reporting system in accordance with claim 1, each of said data sets stored in said database including route specifying data for specifying at least one route between two predetermined points on a map.

8. An information reporting system in accordance with claim 7, wherein said portable terminal includes a second database storing map data, and said display means displays an image based upon said road section data and portions of said map data corresponding to a map of a predetermined area.

9. An information reporting system in accordance with claim 7, one end of said route corresponding to a position based upon the position information data indicative of the current position of said portable terminal.

10. An information reporting system in accordance with claim 9, said route specifying data at least indicating a route toward a shelter appropriate in light of a disaster.

* * * * *